US008839826B2

(12) United States Patent
Eidam

(10) Patent No.: US 8,839,826 B2
(45) Date of Patent: Sep. 23, 2014

(54) DEVICE FOR STORING AND DOSING A SOLVENT

(75) Inventor: Andreas Eidam, Lahntal (DE)

(73) Assignee: Siemens Healthcare Diagnostics Products GmbH, Marburg (DE)

( * ) Notice: Subject to any disclaimer, the term of this patent is extended or adjusted under 35 U.S.C. 154(b) by 673 days.

(21) Appl. No.: 13/073,303

(22) Filed: Mar. 28, 2011

(65) Prior Publication Data

US 2011/0240172 A1 Oct. 6, 2011

(30) Foreign Application Priority Data

Apr. 1, 2010 (EP) ..... 10003658

(51) Int. Cl.

| | |
|---|---|
| ***A61J 1/20*** | (2006.01) |
| ***B65D 23/04*** | (2006.01) |
| ***B65D 81/32*** | (2006.01) |
| *A61J 1/14* | (2006.01) |

(52) U.S. Cl.

CPC ..... *A61J 1/2089* (2013.01); *B65D 81/3205* (2013.01); *B65D 23/04* (2013.01); *A61J 1/1406* (2013.01); *A61J 2001/2013* (2013.01); *A61J 2001/2027* (2013.01)

USPC ..... 141/1; 141/330; 222/81

(58) Field of Classification Search

CPC .... B65D 23/04; B65D 81/32; B65D 81/3205; B65D 2217/00

USPC ..... 141/1, 329–330; 222/80–81

See application file for complete search history.

(56) References Cited

U.S. PATENT DOCUMENTS

| | | | | |
|---|---|---|---|---|
| 3,490,437 | A | 1/1970 | Bakondy et al. | |
| 3,548,562 | A * | 12/1970 | Schwartzman | 53/440 |
| 4,031,895 | A | 6/1977 | Porter | 128/272.1 |
| 4,458,733 | A * | 7/1984 | Lyons | 141/1 |
| 4,516,967 | A * | 5/1985 | Kopfer | 604/87 |
| 4,573,506 | A * | 3/1986 | Paoletti | 141/98 |
| 4,668,219 | A * | 5/1987 | Israel | 604/85 |
| 4,834,149 | A * | 5/1989 | Fournier et al. | 141/1 |
| 4,986,322 | A * | 1/1991 | Chibret et al. | 141/319 |
| 5,071,034 | A * | 12/1991 | Corbiere | 222/80 |
| 5,348,060 | A * | 9/1994 | Futagawa et al. | 141/100 |
| 5,385,547 | A * | 1/1995 | Wong et al. | 604/87 |
| 5,567,048 | A * | 10/1996 | Hammonds | 366/139 |
| 5,743,312 | A * | 4/1998 | Pfeifer et al. | 141/329 |
| 5,791,466 | A * | 8/1998 | Tsals | 206/222 |
| 6,012,450 | A * | 1/2000 | Rubsamen | 128/200.14 |
| 6,021,824 | A * | 2/2000 | Larsen et al. | 141/329 |
| 6,148,996 | A * | 11/2000 | Morini | 206/222 |
| 6,189,580 | B1 * | 2/2001 | Thibault et al. | 141/25 |
| 6,209,738 | B1 * | 4/2001 | Jansen et al. | 215/247 |
| 6,237,649 | B1 * | 5/2001 | Moisio et al. | 141/100 |
| 6,681,946 | B1 * | 1/2004 | Jansen et al. | 215/249 |

(Continued)

FOREIGN PATENT DOCUMENTS

| | | | | |
|---|---|---|---|---|
| DE | 10011502 A1 | 9/2001 | | C07C 39/235 |
| JP | 11047273 A * | 2/1999 | | A61M 5/178 |

(Continued)

*Primary Examiner* — Nicolas A Arnett

(74) *Attorney, Agent, or Firm* — King & Spalding L.L.P.

(57) ABSTRACT

A device for storing and/or dosing a solvent for dissolving a substance that is to be used in liquid form has a container, a mounting mechanism for mounting the container on a vessel, preferably a reagent vessel from the laboratory sector, and an opener for opening the container.

13 Claims, 10 Drawing Sheets

(56) References Cited

U.S. PATENT DOCUMENTS

| | | | | |
|---|---|---|---|---|
| 6,685,691 | B1 * | 2/2004 | Freund et al. | 604/403 |
| 6,945,417 | B2 * | 9/2005 | Jansen et al. | 215/249 |
| 8,226,126 | B2 * | 7/2012 | Johns et al. | 285/3 |
| 8,393,361 | B2 * | 3/2013 | Luchinger et al. | 141/83 |
| 8,398,585 | B2 * | 3/2013 | Matusch | 604/89 |
| 8,555,936 | B2 * | 10/2013 | Gotoh et al. | 141/332 |
| 8,562,582 | B2 * | 10/2013 | Tuckwell et al. | 604/406 |
| 2001/0025672 | A1 * | 10/2001 | Thibault et al. | 141/329 |
| 2004/0129343 | A1 * | 7/2004 | Jansen et al. | 141/329 |
| 2006/0043109 | A1 * | 3/2006 | Masuda | 222/105 |
| 2006/0184103 | A1 | 8/2006 | Paproski et al. | 604/86 |
| 2007/0129673 | A1 | 6/2007 | Bassarab et al. | 604/85 |
| 2009/0159300 | A1 * | 6/2009 | Fabre | 169/9 |

FOREIGN PATENT DOCUMENTS

| | | | | |
|---|---|---|---|---|
| WO | 9815314 | A1 | 4/1998 | A61M 37/00 |
| WO | 02102295 | A2 | 12/2002 | A61J 1/00 |
| WO | 2007020239 | A1 | 2/2007 | A61M 5/24 |

* cited by examiner

DEVICE FOR STORING AND DOSING A SOLVENT

CROSS-REFERENCE TO RELATED APPLICATIONS

This application claims priority to EP Patent Application No. 10003658 filed Mar. 1, 2010, the contents of which is incorporated herein by reference in its entirety.

TECHNICAL FIELD

The present invention relates to a device for storing and/or dosing a solvent for dissolving a substance that is to be used in liquid form.

BACKGROUND

A field in which it is necessary to ensure that substances that have to be stored over a long period of time do not lose their activity or efficacy is the field of in vitro diagnostics. In this field, liquid reagents are used which, for the detection of an analyte, are brought into contact with a biological sample, e.g. with blood plasma. The reagents often contain biologically or chemically active substances, for example antibodies, enzymes, etc., which are essential for carrying out the detection method. A problem is that many substances lose their efficacy if they are stored over a long period of time in liquid form. To make these compositions stable and ensure sufficient biological activity over an acceptable period of time, they are therefore usually made available as dry powder, for example by means of methods such as spray drying, mass crystallization, vacuum drying, foam drying or lyophilization. It is only just before using the reagent that the user produces the liquid reagent by mixing the dried substance with a suitable liquid reconstitution medium.

Other fields in which dry powder and associated solvent are usually made available and stored separately are those of pharmaceutical or cosmetic compositions and foodstuffs, which would also have inadequate stability in the liquid state.

The conventional method of reconstitution is laborious and time-consuming for the user. This method also involves the risk of the user using the wrong reconstitution medium, of the wrong volume of reconstitution medium being used, or of contamination being caused. Such errors can lead to increased variance in respect of efficacy and, in the worst case, can cause the reconstituted liquid composition to be unusable. Other sources of error affecting the reconstitution of lyophilized products and possibly leading to the aforementioned disadvantages are the different types of aids, such as filling aids, measuring beakers, pipets and pipet tips, that are used by the user during reconstitution.

Various devices and methods were therefore developed to ensure the separate storage of lyophilisates and liquid reconstitution media.

DE 10011502 A1 describes a closure element for a reaction vessel. This closure element has a reservoir with a solid mixture that is required in a reaction. By placing the closure element onto the reaction vessel and turning the device over, the solid mixture is mixed with the liquid sample contained in the reaction vessel. However, this device has the disadvantage that, when the two components are being mixed, some of the solid mixture can always remain in the reservoir, which can lead to differences in the concentration of the solid mixture in the sample.

Moreover, WO 02102295 A2 discloses a spike with which liquid under pressure can be introduced, without formation of foam, into an ampule that contains a substance. This spike is intended in particular for reconstitution of a lyophilized medicine and is accordingly designed such that only a minimum of reconstituted medicine remains in the ampule. However, the spike has the disadvantage that the device in which it is used in WO 02102295 A2 is very complex and difficult to operate.

Moreover, WO 2007020239 A1 explains the structure of a container with two chambers for storing and combining a solid lyophilisate and a reconstitution medium. The container includes a stopper, which separates the two chambers from each other in the starting state. When the reconstitution is to take place, the stopper is maneuvered into a recess in the container wall, as a result of which a connection between the two chambers is established that permits the reconstitution of the lyophilisate. However, the stopper is always in the way during the reconstitution reaction, with the result that the reaction can be quite protracted. Moreover, there is no guarantee of the contents of the two chambers being completely mixed together.

SUMMARY

According to various embodiments, a device can be provided that allows a substance, preferably a dry powder, to be mixed with a liquid medium quickly, completely, and without the use of additional aids, such that the substance is then present with a defined concentration in the liquid medium.

Furthermore, according to various embodiments, a device that has a less complex design and that can be produced less expensively than devices known from the prior art can be provided.

According to various embodiments, a device can be provided that ensures simple handling free of errors.

Hence, according to various embodiments, a device can be provided that is used to store and/or dose a solvent and that avoids the abovementioned disadvantages.

According to various embodiments, a device can be provided which is used to store and/or dose a solvent and which ensures that a substance, after reconstitution with a solvent, is present in a predetermined, reproducible concentration.

According to an embodiment, a device for storing and/or dosing a solvent, may comprise a) a container with a first interior that can be filled with a fixed amount of the solvent, and b) a mounting mechanism for mounting the container on a vessel that has a second interior into which the solvent from the container can be dosed, and c) a means for opening the container, as a result of which a continuous connection for the solvent can be established from the first interior of the container to the second interior of the vessel.

According to a further embodiment, the container may contain a fixed amount of the solvent and a gas bubble. According to a further embodiment, the container may comprise a first, outer container as housing, and a second, inner container, wherein the inner surface of the second, inner container forms the boundary of the interior of the container that can be filled with the solvent. According to a further embodiment, the mounting mechanism may be composed of an elastic stopper with an opening. According to a further embodiment, the area of the mounting mechanism to be secured on the container and/or the area of the mounting mechanism to be secured on the vessel may have a profiled indentation or a plug element of a plug connection. According to a further embodiment, the area of the mounting mechanism to be secured on the vessel may have a stopper. According to a further embodiment, the mounting mechanism additionally may comprise a seal. According to a further embodiment, the means for opening the container can be arranged on the mounting mechanism and/or on the container. According to a further embodiment, the means for opening the container can be a device for perforating the container. According to a further embodiment, the means for opening the container can be formed by a container that is deformable by pressure and that has a predetermined breaking point for the emergence of the solvent. According to a further embodiment, the device additionally may have a means for opening a closure device of the vessel. According to a further embodiment, the means for opening the closure device of the vessel can be a device for perforating the closure device. According to a further embodiment, the device for perforating the closure device can be arranged on the container. According to a further embodiment, the device for perforating the closure device may form a unit with the device for perforating the container.

According to another embodiment, a kit for a diagnostic test method, may contain a device as described above, which device contains a defined amount of a solvent, and a vessel with a substance that is to be dissolved.

DETAILED DESCRIPTION

Figure 1:
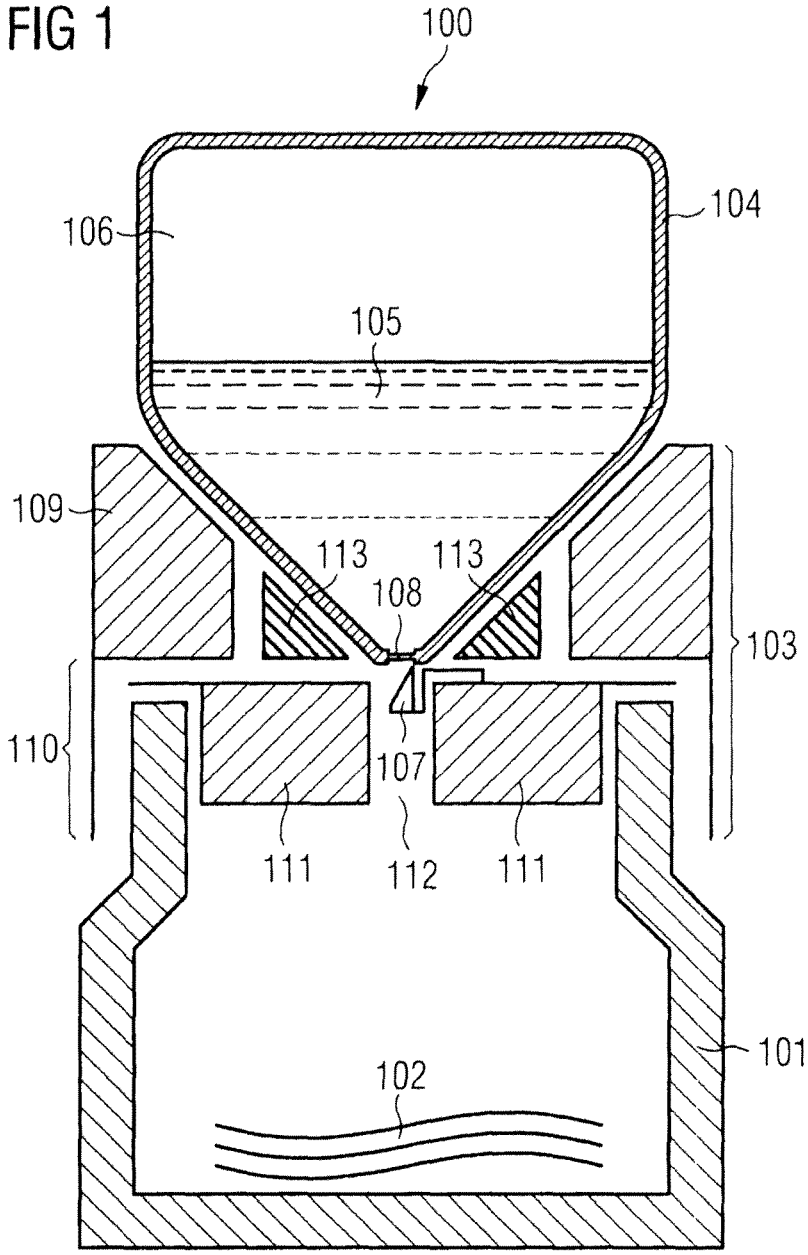
FIG. 1 shows a schematic cross-sectional view of an embodiment of the device.

According to various embodiments, a device for storing and/or dosing a solvent, may have a) a container with a first interior that can be filled with a fixed amount of the solvent, and b) a mounting mechanism for mounting the container on a vessel, which has a second interior into which the solvent from the container can be dosed, and c) a means for opening the container, as a result of which a continuous connection for the solvent can be established from the first interior of the container to the second interior of the vessel.

The term "solvent" is intended hereinbelow to designate a liquid for dissolving, dispersing or mixing a substance. In particular, it can mean a reconstitution medium for a lyophilisate, e.g. distilled water, deionized water, buffer solutions, salt solutions or other suitable liquids.

The term "substance" is intended hereinbelow to designate a substance which is in a storable state and which, for example, is present as a liquid, as a gel or as a solid, e.g. as powder, as crystals or as lyophilisate, but which, for its intended purpose, still has to be brought into contact with a solvent, that is to say has to be reconstituted. The term "reconstitution" is to be interpreted broadly within the meaning of the present invention and includes bringing a solvent into contact with a solid, gel-like or liquid substance.

The term "container" is intended hereinbelow to designate a device with an interior that is suitable for receiving and storing a solvent. In the state of use, the interior of the container is filled with the solvent and hermetically sealed. In an embodiment, a gas bubble is also present in the interior of the container and has the effect of providing an overpressure relative to the pressure in the vessel into which the solvent is to be dosed. This has the advantage that, after the container has been opened, the solvent is as it were sucked out of the container, thus ensuring the greatest possible emptying of the container. In this embodiment, the interior of the container preferably may have no sharp corners or edges, but instead rounded corners or edges, in order to avoid adherence of solvent residues.

In one embodiment of the container, the inner surface of the container forms the boundary of the interior. The container can preferably be made of a plastic material, e.g. of polyethylene terephthalate (PET). The container can be preferably made of a transparent material such that the user can monitor the filling level and the emptying of the container. In another embodiment, the container comprises a first, outer container as housing, and a second, inner container, e.g. a thin-walled plastic bag, wherein the inner surface of the inner container forms the boundary of the interior.

The inner surface of the interior of the container preferably may have liquid-repelling, preferably hydrophobic properties. This has the effect that the solvent runs off as beads when the container is being emptied, as a result of which no solvent residues are left behind in the container. This in turn ensures a precise dosing of the solvent and the production of a defined concentration of the substance in the solvent.

In one possible embodiment, the container for the solvent is a screw-neck bottle made of plastic or glass.

The term "vessel" is intended hereinbelow to designate a device with an interior that is suitable for receiving and storing a substance, e.g. a lyophilisate, and into which the solvent from the container can be dosed in order to dissolve, disperse or mix the substance, i.e. for reconstitution of the substance. The term "vessel" includes in particular laboratory vessels suitable for chemical purposes, e.g. test tubes, reagent bottles, e.g. made of glass, plastic, metal or porcelain, laboratory vessels with standard ground joint, etc.

The term "fixed amount" is intended hereinbelow to designate a defined amount. It is important that the container of a device according to various embodiments is filled with a defined amount of a solvent and/or releases only a fixed amount, so as to ensure that the substance, after reconstitution with the solvent, is present in a desired concentration.

The term "mounting mechanism" is intended hereinbelow to designate a mechanism for mounting the container on a vessel. The expression "mounting the container on a vessel" is to be interpreted broadly and also includes, for example, arranging the container "completely outside" or "completely inside" or "partially inside" the vessel. Any form of arrangement is conceivable as long as it ensures that a sealed connection can be established between the interior of the container with the solvent and the interior of the vessel with the storable substance, such that the solvent stored in the container can be dosed into the vessel without any loss, so as to come into contact with the substance stored therein. For this purpose, the mounting mechanism of the device according to various embodiments comprises a first area for securing on the container, and a second area for securing on the vessel.

Figure 3:
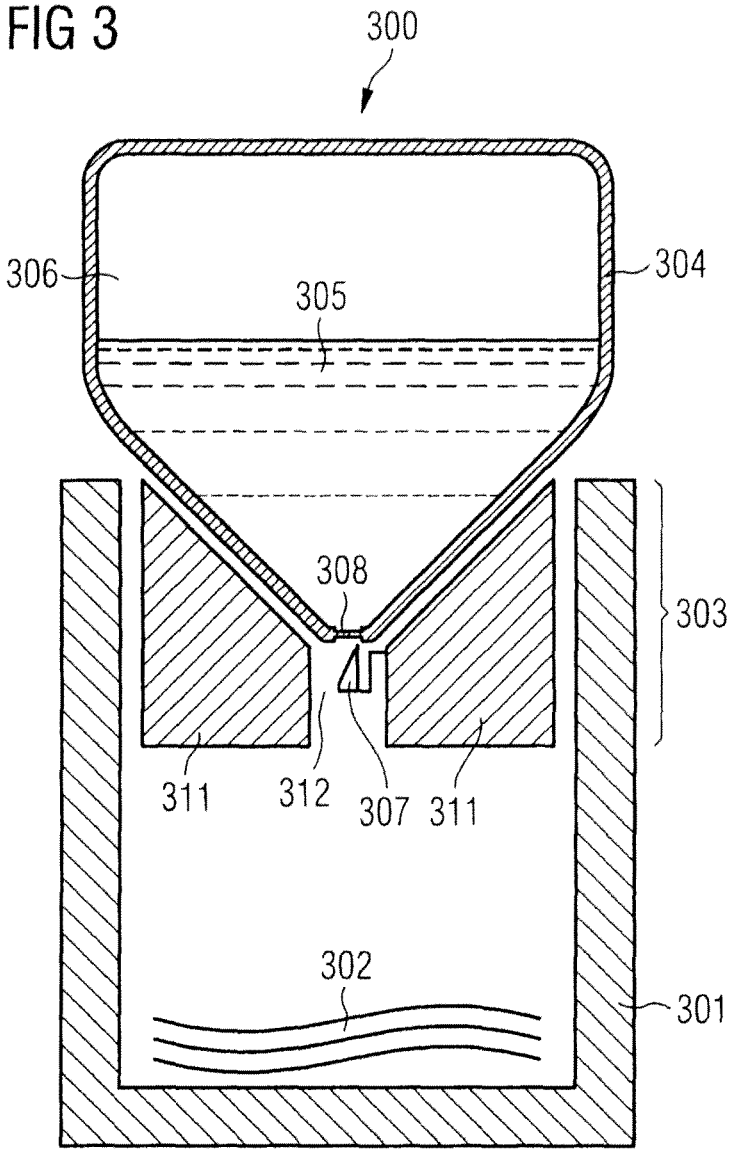
FIG. 3 shows a schematic cross-sectional view of an alternative embodiment of the device.

In one embodiment, the mounting mechanism is composed of a single component, for example an elastic stopper with an opening, which stopper is pressed into the opening of the vessel (see FIG. 3 for example). The side surfaces of the stopper ensure the securing on the vessel by means of the pressing force generated. The upper surface of the stopper is shaped according to the design of the container with the solvent, such that the container can be connected to the stopper with a form fit.

In another embodiment, the area of the mounting mechanism to be secured on the vessel comprises a profiled indentation, e.g. a thread, which permits connection with a high retention force to a vessel that has a suitable complementary indentation, e.g. a counter-thread.

In another embodiment, the area of the mounting mechanism to be secured on the vessel comprises a plug element of a plug connection, e.g. a pin, which likewise permits connection with a high retention force to a vessel that has a suitable complementary plug element, e.g. a blind hole for the pin.

In another embodiment, the area of the mounting mechanism to be secured on the container is designed in such a way that a form-fit connection can be made to a suitably shaped container. For example, an area of the mounting mechanism can be sleeve-shaped, such that a container of an exact fit can be inserted.

Moreover, the area of the mounting mechanism to be secured on the container can comprise a profiled indentation, e.g. a thread, which permits connection with a high retention force to a container that has a suitable complementary indentation, e.g. a counter-thread.

Moreover, the area of the mounting mechanism to be secured on the container can comprise a plug element of a plug connection, e.g. a pin, which likewise permits connection with a high retention force to a container that has a suitable complementary plug element, e.g. a blind hole for the pin.

The mounting mechanism can be formed in one piece. It can, for example, be made of a plastic that is suitably shaped by an injection molding technique. A one-piece mounting mechanism in the form of a stopper may be preferably made of an elastic material, e.g. cork, natural rubber or vulcanized rubber. It is also possible for the mounting mechanism to be made in one piece but from different materials. For example, the area of the mounting mechanism to be secured on the vessel can be configured in the form of a stopper, e.g. of rubber, and the area of the mounting mechanism to be secured on the container can be configured in the form of a sleeve, e.g. of plastic, such that a container of an exact fit can be inserted. The various component parts can be connected non-releasably to one another, e.g. using a welding technique.

In one embodiment, the mounting mechanism comprises other component parts, for example a seal. If the device according to various embodiments is such that the solvent from the container has to pass through an opening in the mounting mechanism in order to enter the vessel containing the substance to be dissolved (see FIG. 1 for example), a seal, e.g. in the form of a rubber ring surrounding the opening in the mounting mechanism, avoids unwanted escape of solvent during the dosing process. When a device according to various embodiments is used with a closed vessel in which there is an under pressure, the seal further avoids a situation where the under pressure in the vessel is compensated by the atmospheric pressure when the closure device of the vessel is opened. This is advantageous since, after the container has been opened, the solvent is as it were sucked into the vessel, thus resulting in the greatest possible emptying of the container.

Another component part of the mounting mechanism can be a stopper with an opening, which stopper is inserted into the opening of the vessel that contains the substance to be dissolved. A stopper of this kind, as a component part of the mounting mechanism, can have a device for opening the container (see FIG. 1 for example).

The expression "means for opening the container" is to be interpreted broadly and is intended herein below to designate a means that is able to effect an opening of the container. The means for opening the container is such that it effects the opening of the container only when actuated, thus ensuring that a continuous connection for the solvent is established from the interior of the container to the interior of the vessel only at the moment when the substance is actually intended to be dissolved or mixed with the solvent.

The means for opening the container can be a device that is arranged on the mounting mechanism and/or on the container. It may be preferably a device that is able to effect perforation of the container, for example a spike, a hook or a plunger. This type of perforating device may be preferably actuated by a turning, pressing or sliding mechanism. In an embodiment, the opening device is composed of a first part arranged on the container, e.g. a spur with an elevation, and of a second part arranged on the mounting mechanism, e.g. a second elevation, which provides mechanical resistance for the first part (see FIG. 4 for example). Such an opening device can be actuated by turning or sliding, as a result of which the first part, by means of the resistance of the second part, is partially separated from the container at a predetermined breaking point and opens the container by perforation.

Alternatively, the means for opening the container is composed of structural features of the container (see FIG. 6 for example). For this purpose, the container is deformable by pressure and also has a predetermined breaking point for the emergence of the solvent. When pressure is applied to the container, e.g. by pressing with the fingers, the internal pressure of the container is increased, such that the predetermined breaking point is damaged. In this way, a continuous connection for the solvent is established from the interior of the container to the interior of the vessel.

In an embodiment, the means for opening the container also comprises structural features of the mounting mechanism (see FIG. 6 for example). For this purpose, the mounting mechanism is such that it optimally influences the deformation of the container, e.g. by virtue of the fact that the area of the mounting mechanism to be secured on the container has particularly flexible or particularly rigid subsidiary areas.

In an embodiment of the device for storing and/or dosing a solvent, the device also has a vessel with an interior into which the solvent can be dosed from the container. A substance, e.g. a lyophilisate, to be brought into contact with the solvent is located in the interior of the vessel.

The device according to various embodiments is suitable for dosing a solvent into many kinds of vessels.

It may be particularly desirable for the device according to various embodiments to be used for dosing a solvent into vessels that are initially closed and that contain a lyophilisate, for example. Such vessels are usually closed hermetically, i.e. airtight, by a closure device, usually a rubber stopper. There is often an under pressure in these vessels.

In one embodiment of the device for storing and/or dosing a solvent, the device therefore also has a means for opening the closure device of the vessel. This allows a solvent to be dosed into a vessel containing a substance without the vessel first having to be opened in a separate work step. This has the advantage of ensuring that the fingers or other maneuvering aids do not touch the vessel opening, thus avoiding possible problematic handling of the vessel during opening thereof and thereby reducing the risk of contamination.

The means for opening the closure device of the vessel is designed in such a way that it is only when it is actuated that it effects the opening of the closure device of the vessel, thereby ensuring that a continuous connection for the solvent, from the interior of the container to the interior of the vessel, is established only at the moment when the substance is actually intended to be dissolved or mixed with the solvent.

The means for opening the closure device of the vessel can be a device that is arranged on the mounting mechanism. It may be preferably a device that is able to effect perforation of the closure device of the vessel, for example a spike, a hook or a plunger. Another means for opening the closure device of the vessel involves adapting the container in the area of the container that faces the closure device of the vessel and that can be brought into contact with the latter. For example, the mouth area of the container can be designed as a perforating device, specifically by virtue of the mouth area, for example, being pointed or having sharp edges and also having sufficient strength, e.g. by strengthening with an impact-resistant material (see FIG. 7C for example). Perforating devices of this kind can be preferably actuated by a turning, pressing or sliding mechanism. In an embodiment, the opening device for opening the closure device of the vessel forms a unit together with the opening device for opening the container, and it is actuated in synchrony with the opening device for opening the container and by means of the same turning, pressing or sliding mechanism as said opening device for opening the container (see FIG. 8 for example). This has the advantage that the solvent in the container and also the substance in the vessel are stored in different, hermetically sealed interiors until the time of reconstitution. Alternatively, the means for opening the closure device of the vessel acts independently of the means for opening the container. For example, an independent function can be achieved if, when the device is mounted on a vessel, the closure device of the vessel is opened by means of a perforating device provided on the mounting mechanism, by turning or pressing of the perforating device, whereas the container is intended to be opened only at a later stage, when the reconstitution is to take place, for example by pressure being applied to the container such that the predetermined breaking point of the container is damaged.

In an embodiment, the device, comprising a container with a solvent, a mounting mechanism for mounting the container on the vessel, and a means for opening the container, and further comprising a means for opening the closure device of the vessel and a seal, is mounted on a vessel that contains a lyophilized substance and that is sealed hermetically by a closure device, preferably a rubber stopper. A continuous connection from the interior of the container to the interior of the vessel is established only at the moment when the substance is intended to be brought into contact with the solvent, by actuation of the opening mechanisms. After an incubation time, for example, the substance is ready for use and can be removed from the vessel. If not all of the ready-to-use substance is intended to be used immediately, the vessel can be resealed, preferably with the device according to various embodiments, and stored after some of the ready-to-use substance has been removed.

A vessel that contains a substance, and a device according to various embodiments that contains a suitable solvent for the substance, can preferably be made available in a test kit for use in an analytical method. According to other embodiments, a test kit may contain a device, for storing and/or dosing a solvent, and a vessel into which the solvent can be dosed and which contains a substance to be dissolved. In the test kit, the vessel and the device can either already be arranged as one unit or can be presented separately.

The device according to various embodiments has the advantage that the user does not require pipetting tools and does not himself have to dose the solvent. The use of the device allows the user to quickly and safely make available a ready-to-use substance with a defined concentration. The concentration deviations between different reconstitution procedures of arrangements comprising a device according to various embodiments and a laboratory vessel of the same type may be preferably ≤1%. Errors attributable to inexact dosing of the solvent or to the wrong choice of solvent are therefore eliminated.

FIG. 1 shows a schematic cross-sectional view of an embodiment of the device 100, which is mounted on a laboratory vessel 101 that contains a substance 102. In this example, the device comprises a container 104 with an interior and with a thin-walled site 108, which container 104 is filled with a fixed amount of a solvent 105 and has a gas bubble 106. The device according to various embodiments further comprises a mounting mechanism 103 for mounting the container 104 on the vessel 101, which mounting mechanism 103 has a first area 109 to be secured on the container and a second area 110 to be secured on the vessel. The mounting mechanism 103 further comprises a stopper 111, with an opening 112, and a seal 113. An opening mechanism 107 for the container 104, in this case a hook, is provided on the stopper 111. This figure shows the device according to various embodiments during the storage of the solvent, e.g. as part of a test kit.

Figure 2:
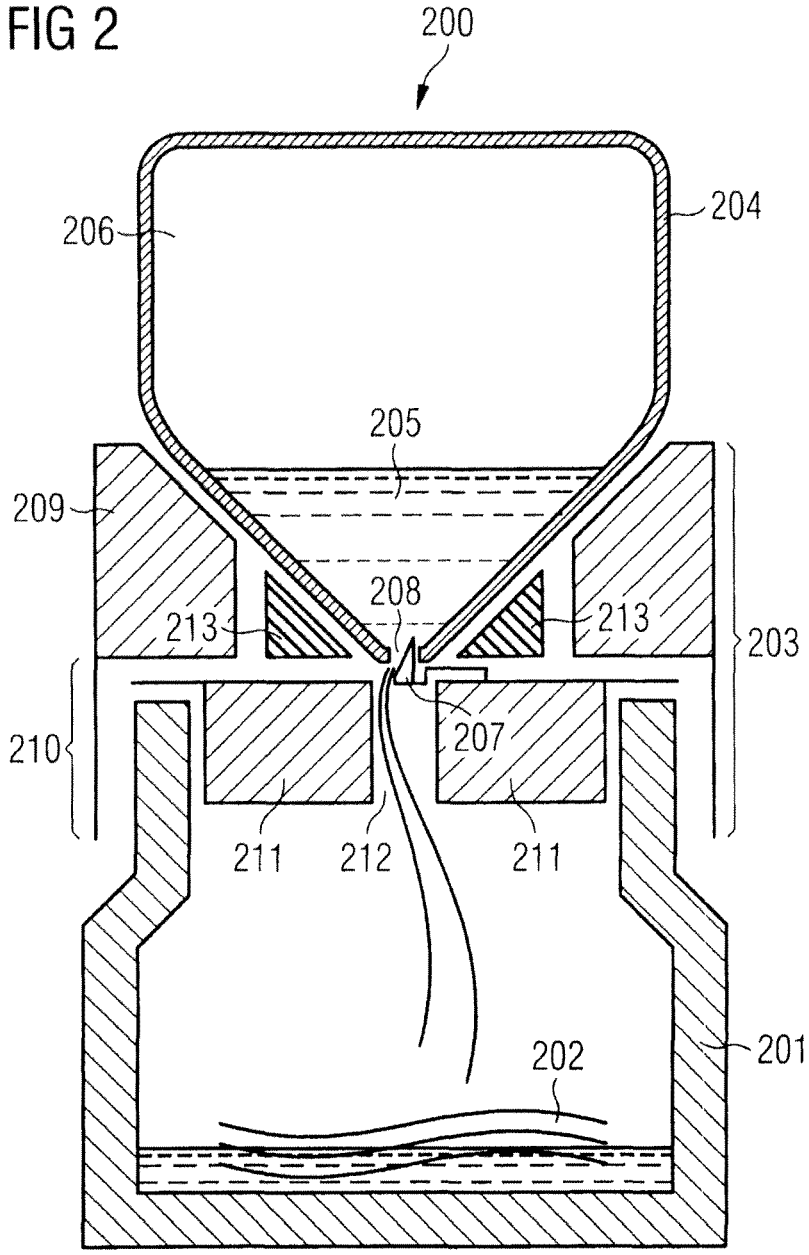
FIG. 2 shows a schematic cross-sectional view of an embodiment of the device.

FIG. 2 shows a schematic cross-sectional view of an embodiment of the device 100 from FIG. 1 (here designated 200) after the actuation of the opening mechanism 207 and during the dissolving or mixing process between the solvent 205 and the substance 202. The thin-walled site 208 of the container has been pierced by the opening mechanism 207, in this case by the hook. The container may be preferably opened by means of the mounting mechanism 203 forming, with the container 204, a unit that is movable relative to the stopper 211 with the opening mechanism 207.

The vessel 201 may be preferably a screw-neck bottle, and the area 210 of the mounting mechanism 203 to be secured on the vessel has a corresponding counter-thread. When the unit composed of mounting mechanism 203 and container 204 is turned relative to the stationary stopper 211 with the opening mechanism 207, this causes the thin-walled site 208 of the container 204 to be punctured, as a result of which a continuous connection from the interior of the container 204 to the interior of the vessel 201 is established for the solvent, and the solvent 205 can flow into the vessel 201.

In an alternative embodiment, the mounting mechanism 203 and the laboratory vessel 201 are connected fixedly to each other. If this is the case, the container 204 is moved relative to the mounting mechanism 203 and the laboratory vessel 201 by means of a turning, pushing or pressing movement, such that the opening mechanism 207 is triggered.

FIG. 3 shows a schematic cross-sectional view of an alternative embodiment of the device 300, which device 300 is mounted on a laboratory vessel 301 that contains a substance 302. In this example, the mounting mechanism 303 is composed of a stopper 311 with an opening 312, which stopper 311 is pressed into the opening of the vessel. The side surfaces of the stopper 311 effect the securing on the vessel 301 via the pressing force generated. The upper surface of the stopper 311 is shaped according to the design of the container 304 with the solvent, such that the container is connected to the stopper with a form fit. An opening mechanism 307 for the container, in this case a hook, is provided on the stopper 311. In this embodiment, the mounting mechanism 303 and the laboratory vessel 301 are fixedly connected to each other. To initiate the dosing procedure, the container 304 is moved relative to the mounting mechanism 303 and the laboratory vessel 301, e.g. by a turning, pushing or pressing movement, such that the opening mechanism 307 is triggered. The thin-walled site 308 of the container 304 is punctured, as a result of which a continuous connection between the interior of the container 304 and the interior of the vessel 301 is established for the solvent 305.

Figure 4:
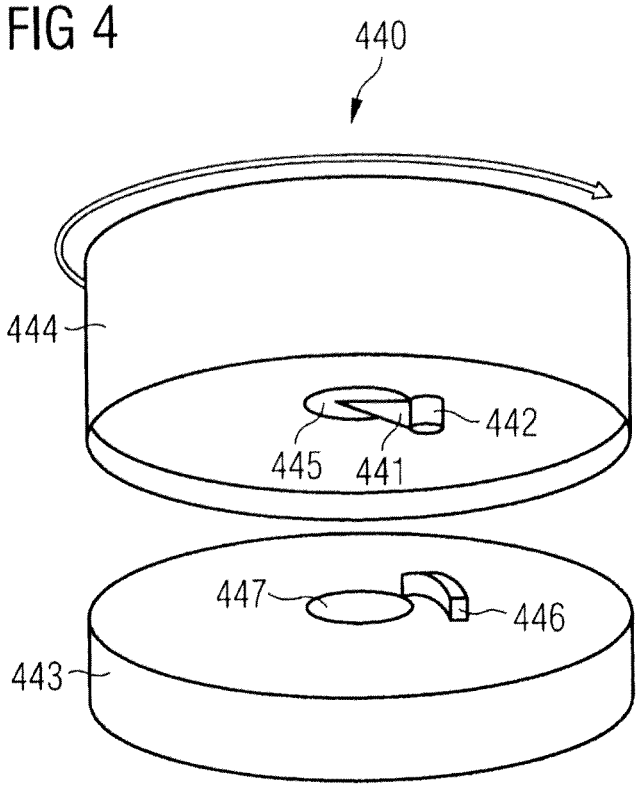
FIG. 4 shows a schematic view of an embodiment of a means 440 for opening a container.

FIG. 4 shows a schematic view of an embodiment of a means 440 for opening a container, which opening means is arranged on the mounting mechanism 443 and on the container 444. In this example, the opening device 440 is composed of a first part, here a spur 441 with an elevation 442, which is arranged near the thin-walled area 445 on the container 444, and a second part 446, here an elevation, which is arranged on the mounting mechanism 443 and which provides a mechanical resistance for the first part, namely the spur 441 with the elevation 442. The mounting mechanism 443 sits on the laboratory vessel (not shown) and comprises an opening 447. If the container 444 is turned counterclockwise (see direction of arrow) about a quarter of a revolution, the elevation 442 abuts against the elevation 446 and breaks off toward the center. The thin-walled area 445 is pierced by the spur 441, and the solvent can pass out of the container through the opening 447 into the laboratory vessel.

Figure 5:
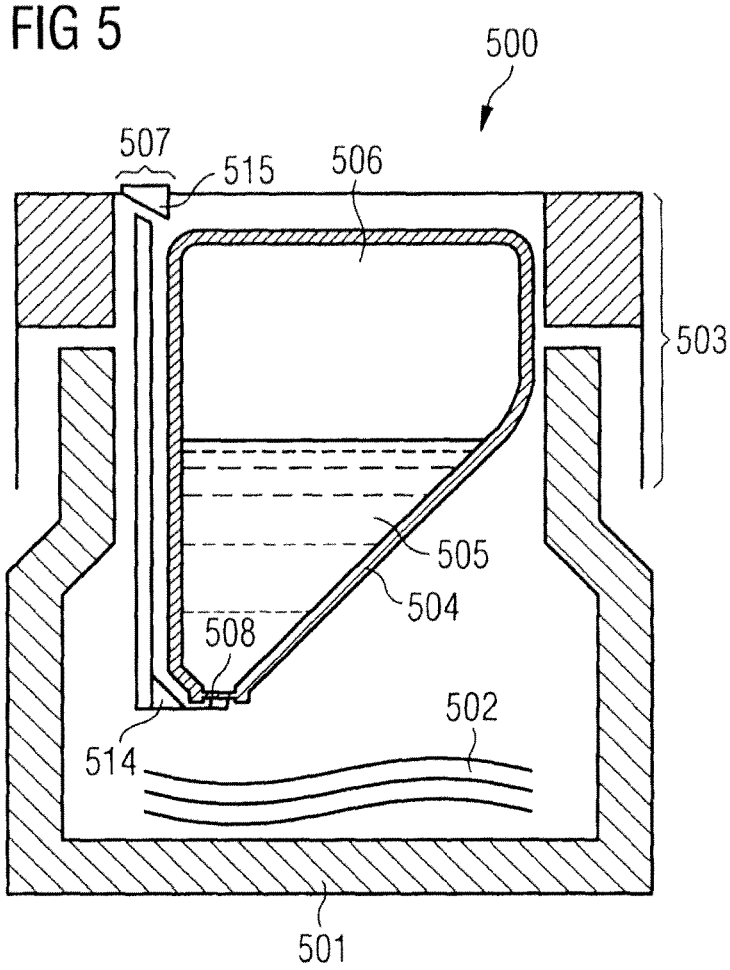
FIG. 5 shows a schematic cross-sectional view of another alternative embodiment of the device.

FIG. 5 shows a schematic cross-sectional view of another alternative embodiment of the device 500. The device 500 is mounted on a laboratory vessel 501 that contains a substance 502. In this example, the device 500 has an opening mechanism 507 with an opener 514 and an opening element 515. The device 500 forms the lid of the laboratory vessel 501. The device 500 further comprises a container 504, having a thin-walled site 508, a solvent 505 and a gas bubble 506.

In this example, the container is arranged in the laboratory vessel through the mounting mechanism, such that in this example too the mounting mechanism is arranged on the container at least during the dosing process.

In this embodiment, the container 504, preferably at an under pressure relative to the gas bubble 506, is brought together with the mounting mechanism 503 onto the laboratory vessel 501. In this example, the opening element 515 acts by pressure or by a rotary movement on the opener 514, such that the latter punctures the thin-walled site 508.

FIG. 6 shows a schematic cross-sectional view of another alternative embodiment of the device 600. The device 600 is mounted on a laboratory vessel 601 that contains a substance 602. In this example, the mounting mechanism 603 has a stopper 611 with a flexible site 614, an opening and a sealing lip 617. The device 600 further comprises a container 604 having an inner container 618, here a thin-walled plastic bag, a predetermined breaking point 616, a solvent 605 and a pressure site 615.

Figure 6A:
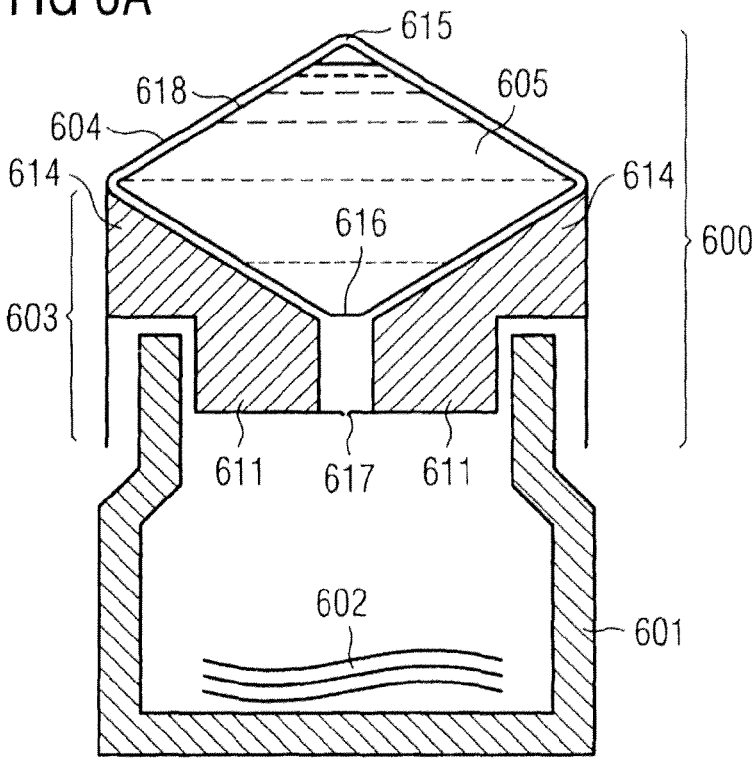
FIG. 6A shows the state prior to actuation of the opening mechanism.
Figure 6B:
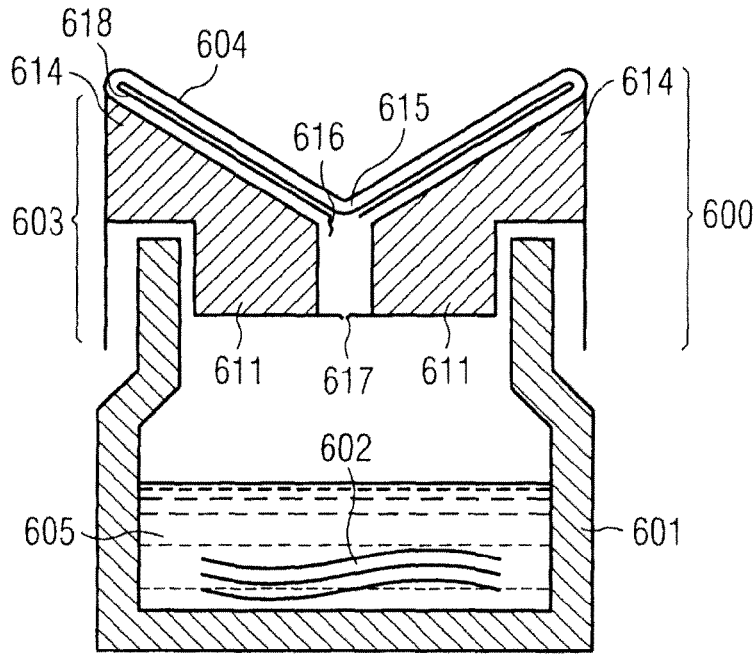
FIG. 6B shows the state during and/or after the reconstitution of the substance by the solvent.

FIG. 6A shows the state prior to actuation of the opening mechanism, whereas FIG. 6B shows the state during and/or after the reconstitution of the substance 602 by the solvent 605.

Pressing on the pressure site 615 of the container 604 causes a deformation in the area of the flexible site 614 of the stopper 611, and the upper part of the container 604 inverts downward (FIG. 6B). As a result of the increased internal pressure, the inner container 618 breaks in the area of the predetermined breaking point 616, and the solvent 605 is dosed into the laboratory vessel 601. If an under pressure relative to the ambient pressure prevails in the laboratory vessel 601, this step can take place in the closed state. In this embodiment, the pressure site 615, the flexible site 614 and the predetermined breaking point 616 form the means for opening the container.

The sealing lip 617 has the effect that, during storage, or subsequently in the state ready for use, the substance 602 comes into contact only with the material of the stopper 611 and not with the container 604, the inner container 618 or the predetermined breaking point 616.

FIG. 7 shows schematic cross-sectional views of other alternative embodiments of parts of the device.

Figure 7A:
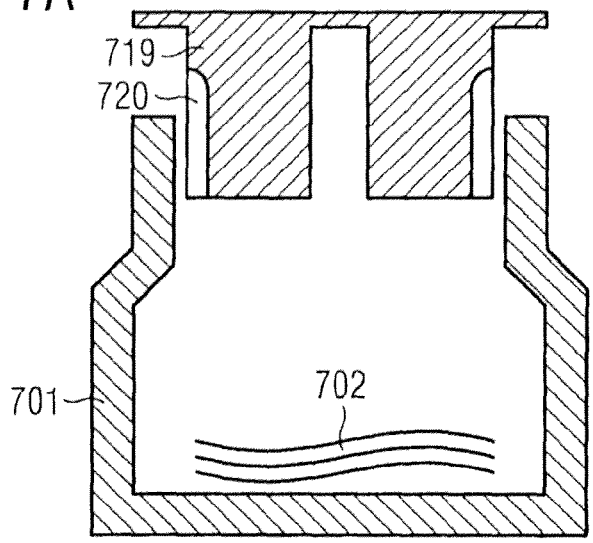
FIG. 7A and FIG. 7B show schematic cross-sectional views of a vessel 701 closed with a stopper.
Figure 7B:
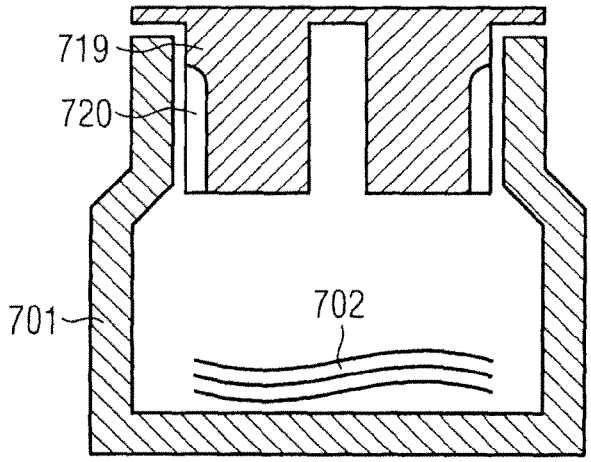

FIG. 7A and FIG. 7B show schematic cross-sectional views of a vessel 701 closed with a stopper 719, said vessel 701 in this case being a screw-neck bottle for lyophilization, with a lyophilized substance 702. Lyophilization vessels of this kind according to the prior art are suitable for use with a device according to various embodiments.

FIG. 7A shows the state before and/or during the lyophilization. At this moment, the screw-neck bottle 701 is only partially closed by the stopper 719. Since the stopper 719 is pressed only about half way into the vessel opening, the groove-shaped recesses 720 in the stopper 719 permit gas exchange between the vessel interior and the environment during lyophilization.

FIG. 7B shows the state after freeze-drying has taken place. Upon completion of the lyophilization, the stopper 719 is pressed fully into the screw-neck bottle 701, as a result of which the groove-shaped recesses 720 are closed and the lyophilized substance 702 remains sealed under vacuum in an airtight manner.

Figure 7C:
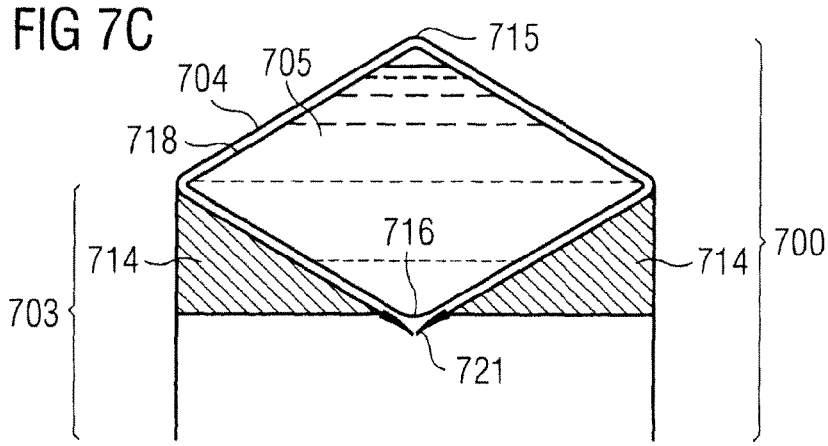
FIG. 7C shows a schematic cross-sectional view of another alternative embodiment of the device.

FIG. 7C shows a schematic cross-sectional view of another alternative embodiment of the device 700. In this embodiment, the device comprises a mounting mechanism 703, in this case a screw closure with a central opening, and a container 704, having an inner container 718, in this case a thin-walled plastic bag. The inner container 718 contains a solvent 705 and has a predetermined breaking point 716, a pressure site 715 and a perforating device 721, in this case the pointed, impact-resistant mouth area of the container 704. The perforating device 721 is the means for opening the closure device of the vessel, here the stopper 719.

In this embodiment, the pressure site 715, the flexible site 714 and the predetermined breaking point 716 form the means for opening the container.

Figure 7D:
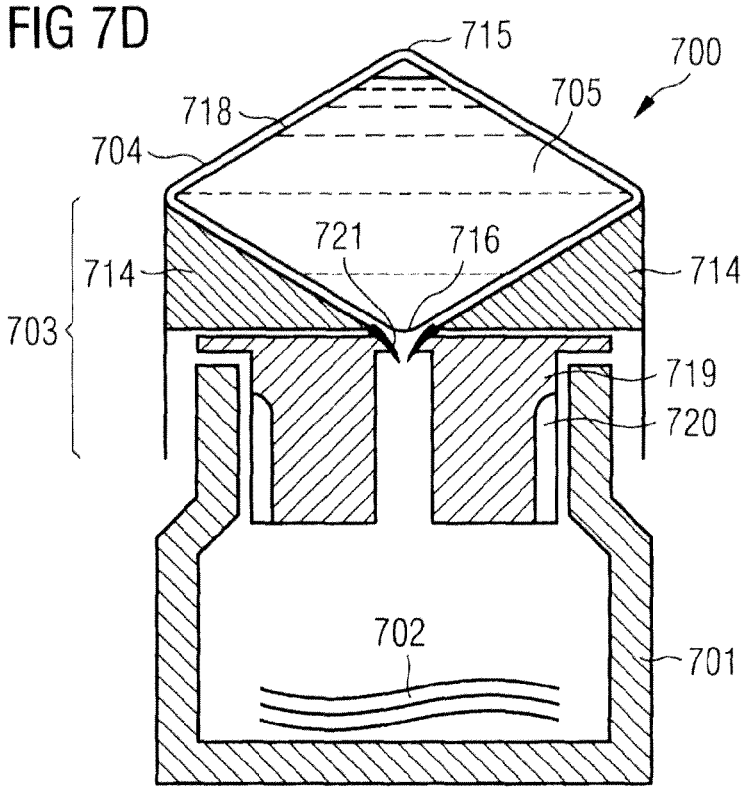
FIG. 7D and FIG. 7E show schematic cross-sectional views of the embodiment of the device.
Figure 7E:
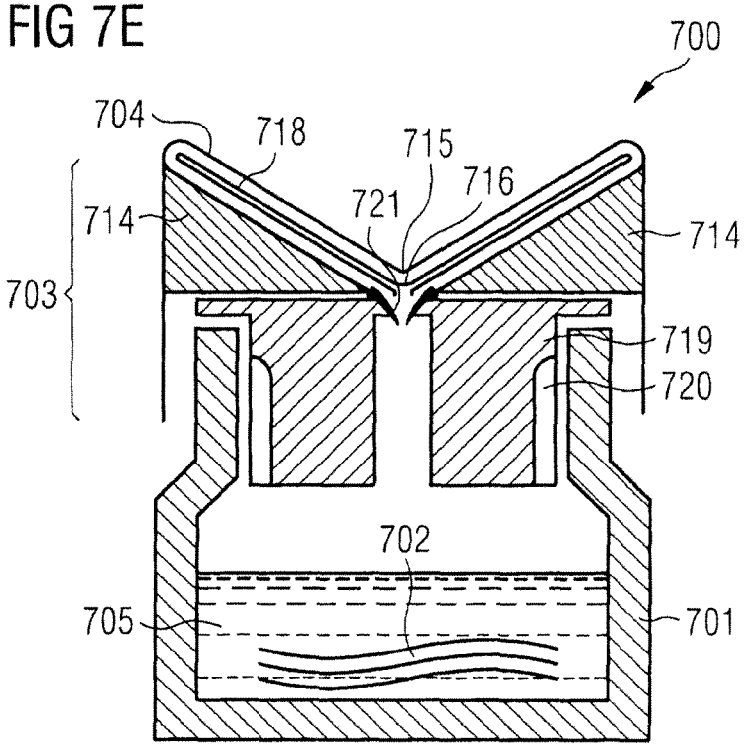

FIG. 7D and FIG. 7E show schematic cross-sectional views of the embodiment of the device 700 as is described in FIG. 7C.

The device 700 is mounted via a screw closure onto a vessel 701 that contains a substance 702.

FIG. 7D shows the state prior to the actuation of the opening mechanism, while FIG. 7E shows the state during and/or after the reconstitution of the substance 702 by the solvent 705.

In this example, the device 700 can be mounted on the vessel 701, at first being only incompletely screwed thereon, and stored with this vessel 701 (FIG. 7D). At the time when the reconstitution is to take place, the device is screwed completely onto the vessel, as a result of which the perforating device 721, here the pointed, impact-resistant mouth area of the container 704, punctures the closure device of the vessel 701, here the stopper 719.

The means for opening the container is actuated independently of the device for opening the vessel. Pressing on the pressure site 715 on the container 704 causes a deformation in the area of the flexible site 714 of the mounting mechanism 703, and the upper part of the container 704 inverts downward (FIG. 7E). As a result of the increased internal pressure, the inner container 718 breaks in the area of the predetermined breaking point 716, and the solvent 705 is dosed into the vessel 701. If there is an under pressure in the laboratory vessel 701, this step can take place in the closed state. In this embodiment, the pressure site 715, the flexible site 714 and the predetermined breaking point 716 form the means for opening the container.

The device 700 can be unscrewed after reconstitution has taken place. The substance 702 now lies ready to use in the screw-neck bottle 701. In order to access the ready-to-use substance, a pipet can be placed through the opening of the stopper 719. In this way, the ready-to-use substance is also protected to a large extent from evaporation if the mounting mechanism 703 has been removed. If the ready-to-use substance is not used all at once, the device 700 is also suitable for reclosing the screw-neck bottle 701.

Figure 8A:
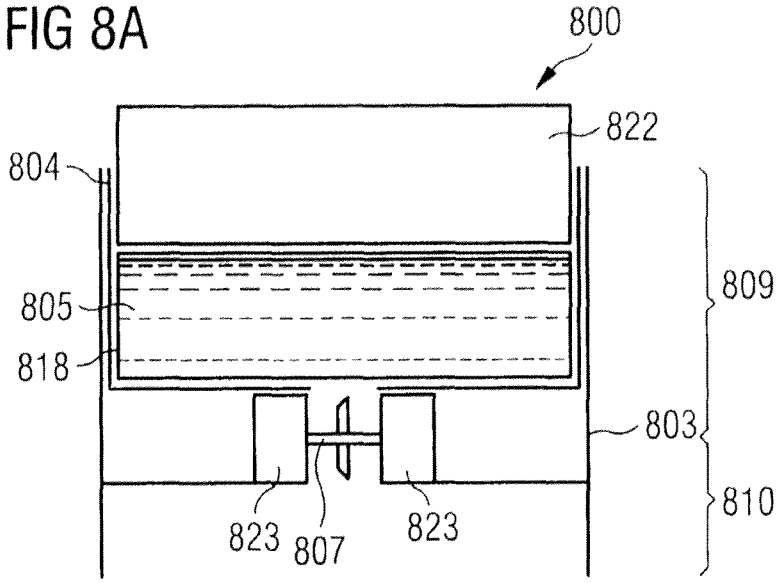
FIG. 8A shows a device 800 according to an embodiment.

FIG. 8 shows schematic cross-sectional views of another alternative embodiment of the device 800 (FIG. 8A).

FIG. 8A shows a device 800 according to various embodiments, comprising a mounting mechanism 803, whose area 810 to be secured on the vessel preferably has a thread. The area 809 of the mounting mechanism 803 to be secured on the container is shaped to match a container 804. The container 804 comprises an inner container 818, here a thin-walled plastic bag, containing the solvent 805. Here, the container 804 further comprises a sliding unit 822, which is able to slide inside the container and with which a uniform pressure can be applied to the inner container 818. The mounting mechanism 803 further comprises an opening mechanism 807, here a two-ended spur on a holding element, for opening the container and for opening the closure device of a vessel. Deformable spacers 823, for example elastic elements made of rubber, are provided to the sides of the opening mechanism, protrude beyond the two-ended spur and prevent the opening mechanism from being triggered too early.

Figure 8B:
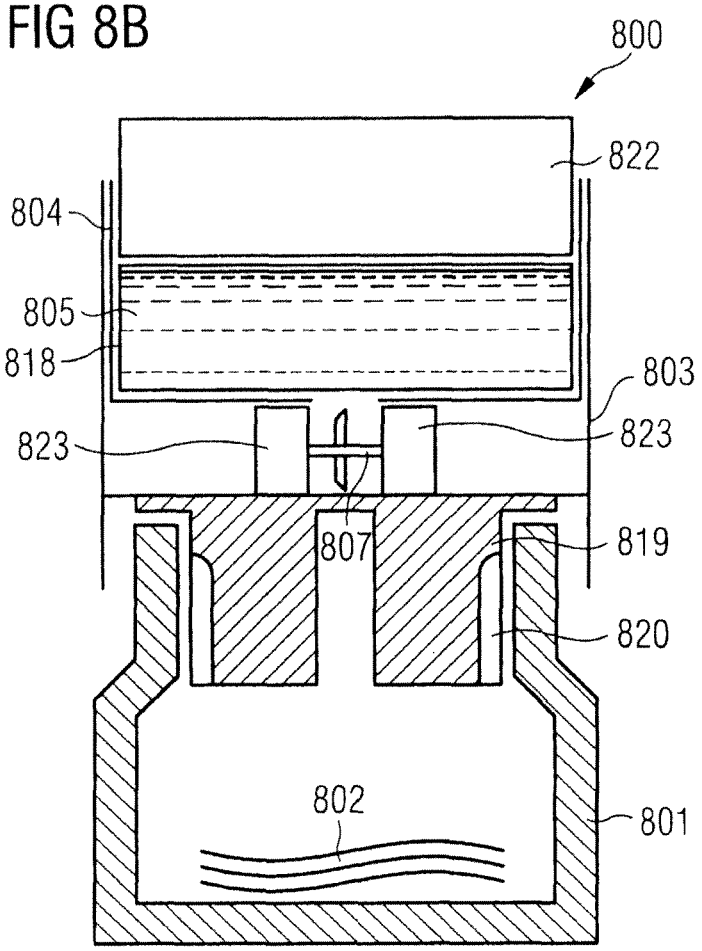
FIG. 8B and FIG. 8C show schematic cross-sectional views of the embodiment of the device of FIG. 8A.
Figure 8C:
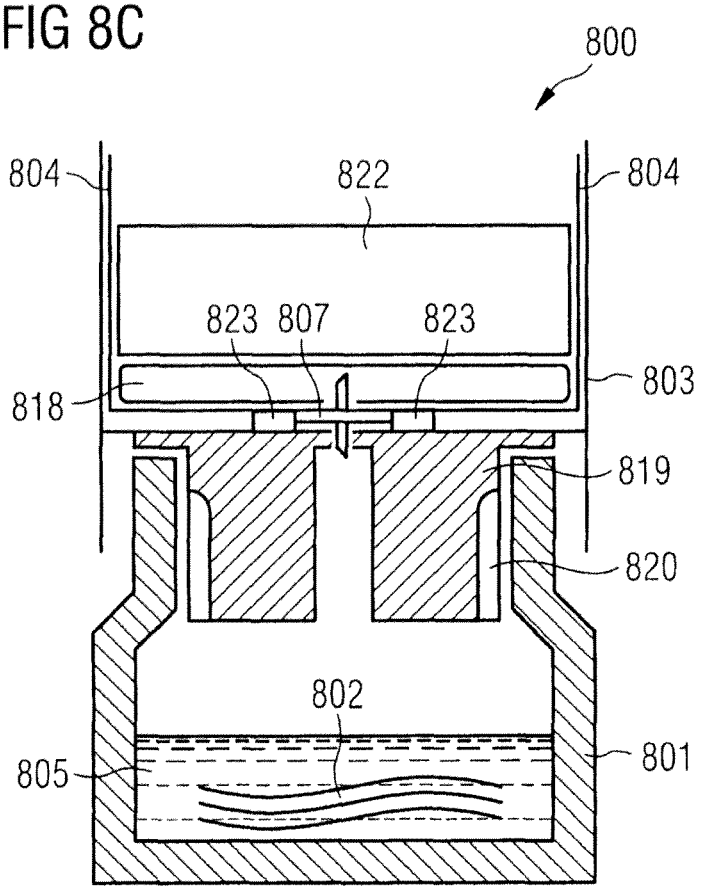

FIG. 8B and FIG. 8C show schematic cross-sectional views of the embodiment of the device 800 as described in FIG. 8A. The device 800 may be preferably mounted by means of a screw closure onto a vessel 801 that contains a substance 802. The vessel 801 is also closed by a closure device, here a stopper 819.

FIG. 8B shows the state prior to actuation of the opening mechanism, while FIG. 8C shows the state during and/or after the reconstitution of the substance 802 by the solvent 805.

In this example, the device 800 can be screwed onto the vessel 801 and stored with the latter (FIG. 8B), e.g. as part of a test kit. When the reconstitution is to take place, the spacers 823 are compressed, e.g. by vertical pressure applied by the fingers to the sliding unit 822, and the two-ended spur of the opening mechanism 807 punctures the inner container 818 and the closure device of the vessel, here the stopper 819. By way of this continuous connection between the inner container 818 and the interior of the vessel 801, the solvent 805 can travel into the vessel 801 and mix with the substance 802.

There may be preferably an underpressure in the interior of the hermetically sealed vessel 801. This promotes complete emptying of the inner container 818.

| List of reference signs | |
|---|---|
| Device | 100, 200, 300, 500, 600, 700, 800 |
| Vessel | 101, 201, 301, 501, 601, 701, 801 |
| Substance | 102, 202, 302, 502, 602, 702, 802 |
| Mounting mechanism | 103, 203, 303, 443, 503, 603, 703, 803 |
| Container | 104, 204, 304, 444, 504, 604, 704, 804 |
| Solvent | 105, 205, 305, 505, 605, 705, 805 |
| Gas bubble | 106, 206, 306, 506 |
| Opening mechanism | 107, 207, 307, 507, 807 |
| Thin-walled site | 108, 208, 308, 508 |
| Area of the mounting mechanism to be secured on the container | 109, 209, 809 |
| Area of the mounting mechanism to be secured on the vessel | 110, 210, 810 |
| Stopper as component part of the mounting mechanism | 111, 211, 311, 611 |
| Opening (in the stopper) | 112, 212, 312 |
| Seal | 113, 213 |
| Means for opening a container | 440 |
| Spur | 441 |
| Elevation | 442, 446 |
| Thin-walled area | 445 |
| Opening | 447 |
| Opener | 514 |
| Opening element | 515 |
| Flexible site | 614, 714 |
| Pressure site | 615, 715 |
| Predetermined breaking point | 616, 716 |
| Sealing lip | 617 |
| Inner container | 618, 718, 818 |
| Stopper (as vessel closure device) | 719, 819 |
| Groove-shaped recess | 720, 820 |
| Perforating device | 721 |
| Sliding unit | 822 |
| Spacer | 823 |

What is claimed is:

1. A device for at least one of storing and dosing a solvent, said device comprising:

a vessel defining a vessel interior, a stopper adjustably mounted in an opening defined in an upper portion of the vessel, a container comprising:

an interior that can be filled with a fixed amount of the solvent, an integral mounting portion of the container configured for releasable connection with an outer surface of the upper portion of the vessel, such that the container secures directly to the vessel, and a device configured to create an opening in the stopper upon securing the mounting portion of the container to the upper portion of the vessel, and a means for opening the container, wherein creating the opening in the stopper and opening the container provides a continuous connection for the solvent from the interior of the container to the interior of the vessel.

2. The device according to claim 1, wherein the container contains a fixed amount of the solvent and a gas bubble.

3. The device according to claim 1, wherein the container comprises a first, outer container as housing, and a second, inner container, wherein the inner surface of the second, inner container forms the boundary of the interior of the container that can be filled with the solvent.

4. The device according to claim 1, further comprising a plug element configured to secure the container to the vessel.

5. The device according to claim 1, wherein the means for opening the container is arranged on at least one of the mounting mechanism and on the container.

6. The device according to claim 1, wherein the means for opening the container is a device for perforating the container.

7. The device according to claim 6, wherein the perforating device forms a unit with the means for opening the container.

8. The device according to claim 1, wherein the means for opening the container is formed by a container that is deformable by pressure and that has a predetermined breaking point for the emergence of the solvent.

9. A kit for a diagnostic test method, containing a device comprising:

a vessel defining a vessel interior containing a substance to be dissolved, a stopper adjustably mounted in an opening defined in an upper portion of the vessel, a container comprising:

an interior containing a fixed amount of a solvent, an integral mounting portion of the container configured for releasable connection with an outer surface of the upper portion of the vessel, such that the container secures directly to the vessel, and a device configured to create an opening in the stopper upon securing the mounting portion of the container to the upper portion of the vessel, and a means for opening the container, wherein creating the opening in the stopper and opening the container provides a continuous connection for the solvent from the interior of the container to the interior of the vessel.

10. The kit according to claim 9, wherein the container contains a fixed amount of the solvent and a gas bubble.

11. The kit according to claim 9, wherein the container comprises a first, outer container as housing, and a second, inner container, wherein the inner surface of the second, inner container forms the boundary of the interior of the container that can be filled with the solvent.

12. The kit according to claim 9, further comprising a plug element configured to secure the container to the vessel.

13. A method for at least one of storing and dosing a solvent, comprising:

inserting a stopper into an upper portion of a vessel, filling a container comprising a first interior with a fixed amount of the solvent and a circumferential mounting portion, and mounting the container on the vessel by screwing an integral mounting portion of the container onto an outer surface of an upper portion of the vessel such that the container secures directly to the vessel, wherein mounting the container on the vessel creates an opening in the stopper, and opening the container, wherein creating the opening in the stopper and opening the container provides a continuous connection for the solvent is established from the first interior of the container to a second interior of the vessel into which the solvent from the container can be dosed.

* * * * *